US009360170B2

(12) United States Patent
Chen et al.

(10) Patent No.: US 9,360,170 B2
(45) Date of Patent: Jun. 7, 2016

(54) LIGHT EMITTING DIODE BULB WITH GLARE SHIELD STRUCTURE

(75) Inventors: Ming-Yun Chen, Dong Guan (CN); Zuo-Cai Hong, Dong Guan (CN)

(73) Assignee: LIVINGSTYLE ENTERPRISES LIMITED, Dong Guan (CN)

( * ) Notice: Subject to any disclaimer, the term of this patent is extended or adjusted under 35 U.S.C. 154(b) by 206 days.

(21) Appl. No.: 14/126,383

(22) PCT Filed: Jun. 14, 2012

(86) PCT No.: PCT/CN2012/076933

§ 371 (c)(1), (2), (4) Date: Dec. 13, 2013

(87) PCT Pub. No.: WO2012/171467

PCT Pub. Date: Dec. 20, 2012

(65) Prior Publication Data

US 2014/0126221 A1 May 8, 2014

(30) Foreign Application Priority Data

| | | |
|---|---|---|
| Jun. 14, 2011 | (CN) | 2011 2 0199303 |
| Jun. 14, 2011 | (CN) | 2011 2 0199318 |
| Jun. 14, 2011 | (CN) | 2011 2 0199327 |
| Jun. 14, 2011 | (CN) | 2011 2 0199523 |
| Jun. 14, 2011 | (CN) | 2011 2 0199524 |

(51) Int. Cl.

| | |
|---|---|
| ***F21K 99/00*** | (2016.01) |
| ***F21V 23/04*** | (2006.01) |
| *F21V 17/16* | (2006.01) |
| *F21Y 101/02* | (2006.01) |
| *F21Y 103/02* | (2006.01) |

(52) U.S. Cl.

CPC ..... *F21K 9/50* (2013.01); *F21K 9/1355* (2013.01); *F21V 23/0442* (2013.01); *F21V 23/0464* (2013.01); *F21V 23/0471* (2013.01); *F21V 17/164* (2013.01); *F21Y 2101/02* (2013.01); *F21Y 2103/022* (2013.01)

(58) Field of Classification Search

CPC ..... F21V 23/007–23/009; F21V 23/0042; F21V 23/0421; F21V 23/0492

USPC ..... 362/276, 642, 294

See application file for complete search history.

(56) References Cited

U.S. PATENT DOCUMENTS

| | | | | |
|---|---|---|---|---|
| 7,134,771 | B2 * | 11/2006 | Stout | F21S 48/1773 359/601 |
| 7,450,028 | B2 * | 11/2008 | De Godzinsky | H05B 33/0821 340/815.45 |
| 7,817,020 | B2 * | 10/2010 | Turnbull | B60Q 3/023 340/438 |
| 7,914,162 | B1 * | 3/2011 | Huang | B60L 1/14 219/220 |
| 2014/0119034 | A1 * | 5/2014 | Chen | F21K 9/135 362/373 |
| 2014/0126220 | A1 * | 5/2014 | Chen | F21K 9/1355 362/311.02 |

* cited by examiner

*Primary Examiner* — Anabel Ton

(74) *Attorney, Agent, or Firm* — Kirton McConkie; Evan R. Witt

(57) ABSTRACT

The present invention relates to a light emitting diode bulb with a glare shield structure. It uses a glare shield structure to separate the sensor from the light emitting diode. A joggle structure or a sleeve structure is used for the glare shield structure to separately match the separated condenser lens and the lamp base to form glare shield means to prevent the sensor from being interfered by irradiated, refracted or reflected light from the light emitting diode. The structure is simple to be assembled and the cost of assembling is reduced.

12 Claims, 8 Drawing Sheets

LIGHT EMITTING DIODE BULB WITH GLARE SHIELD STRUCTURE

TECHNICAL FIELD

The present invention relates to a light emitting bulb and more particularly relates to a light emitting diode bulb with sensor function.

BACKGROUND

In convention art of a light emitting diode bulb with sensor function, a light emitted diode bulb is disposed with a sensor on its top. The sensor is used for sensing human or ambient light and the light emitting diode bulb is turned on when human enters sensor range of the sensor. Similar technology description may be found in China patent application No. 2005200000991.X and 200810097926.1.

Once a light emitting diode bulb is turned on, the emitted, refracted or reflected light from the light emitting diode bulb may be received by a sensor. This makes the sensor work abnormally and this is the disadvantage of convention art. Accordingly, improvement is needed.

SUMMARY OF INVENTION

For eliminating above described disadvantage, an objective of the present invention is to provide a light emitting diode bulb which uses a glare shield structure to separate the sensor from a light emitting diode for preventing the sensor being affected by the light emitting diode.

Another objective is to provide a light emitting diode bulb that uses a glare shield structure together with a condenser lens, a transparent lamp shade and a lamp base structure so as to prevent light being emitted from a light emitting diode to enter sensing range of a sensor.

Another objective of the present invention is to provide a light emitting diode bulb which has a glare shield structure with a sleeve style or a joggle style structure together with a condenser lens and a lamp base structure. These components are simplified and their assembling is easy, thereby reducing manufacturing cost dramatically.

To achieve the above mentioned objective, a technical solution of the present invention is to provide a light emitting diode bulb with a glare shield structure. The light emitting diode bulb includes a lamp base, a transparent lamp shade, a light emitting diode module, a sensor and a glare shield structure for accommodating the sensor. The glare shield structure separates light from the light emitting diode module to interfere the sensor.

Preferably, the glare shield structure provides a hollow cavity for accommodating a glare shield tube. The sensor near a first end of the glare shield tube.

Preferably, the first end of the glare shield tube extends to the transparent lamp shade or penetrates a through hole of the transparent lamp shade to protrude above the transparent lamp shade or align with the transparent lamp shade. A second end of the glare shield tube is fixed at the lamp base. With respect to the hollow cavity, the light emitting diode module is located outside the glare shield tube and is near the second end of the glare shield tube.

Preferably, the glare shield structure further includes a reflective layer. With respect to the hollow cavity, the reflective layer is fixed at an outer surface of the glare shield tube and faced to the light emitting module.

Preferably, the light emitting diode bulb with the glare shield structure further includes a condenser lens sleeved to outer side or inner side of the glare shield tube. The first end of the glare shield tube extends to the transparent lamp shade or penetrates a through hole of the transparent lamp shade to protrude the transparent lamp shade or align the transparent lamp shade. A second end of the glare shield tube is fixed at the lamp base. With respect to the hollow cavity, the light emitting diode module is located outside the glare shield tube and is near the second end of the glare shield tube.

Preferably, the glare shield structure includes a glare shield tube and a glare shield piece comprising a shield portion that defines a hollow portion. The glare shield piece is disposed within the glare shield tube and near a first end of the glare shield tube. The sensor is disposed in the hollow portion. The second end of the glare shield tube is fixed on the lamp base.

Preferably, with respect to the glare shield piece, the light emitting diode module is located outside the glare shield tube and near the second end of the glare shield tube. The shield portion is tilted toward the light emitting diode module. The upper width of the hollow portion near the transparent shield is larger than its bottom width.

Preferably, the first end of the glare shield tube extends to the transparent lamp shade or penetrates a through hole of the transparent lamp shade to protrude above the transparent lamp shade or align with the transparent lamp shade. With respect to the glare shield piece, the light emitting diode module is located outside the glare shield tube and near the second end of the glare shield tube.

Preferably, the light emitting diode bulb with a glare shield structure further includes a condenser lens fixed at the first end of the glare shield tube. The first end extends to the transparent lamp shade or penetrates a through hole to protrude above the transparent lamp shade or align with the transparent lamp shade. With respect to the glare shield piece, the light emitting diode module is located outside the glare shield tube and near the second end of the glare shield tube.

Preferably, the sensor includes an infrared sensor, a microwave sensor, a light sensor, or any one or a combination thereof.

Preferably, the lamp base includes a heat dissipation device and a lamp cap. The light emitting diode module is disposed at a first end of the heat dissipation device. The glare shield structure is joggled to the first end of the heat dissipation device or accommodated in a first end of a center casing of the heat dissipation device. The lamp cap is disposed at a second end of the heat dissipation device or fixed at a second end of the center casing.

Preferably, the light emitting diode module includes a circuit board disposed with multiple light emitting diodes. The circuit board surrounds the glare shield structure.

Preferably, the circuit board near the glare shield structure is higher than the circuit board which is away from the glare shield structure.

To achieve the above objective, the present invention further provides an embodiment of a light emitting diode bulb with a glare shield structure which includes a lamp base, a transparent lamp shade, a light emitting diode module, a sensor and a glare shield structure for accommodating the sensor. The sensor is near a first end of the glare shield structure. The light emitting diode module is near a second end of the glare shield structure. The glare shield structure prevents light emitted from the light emitting module to interfere the sensor.

Preferably, the glare shield structure is a glare shield tube for providing an hollow cavity for accommodating the sensor.

Preferably, there is a segment offset relation between the first end and the second end of the glare shield tube. The first end extends to the transparent lamp shade or penetrates a through hole of the transparent lamp shade to protrude above the transparent lamp shade or align with the transparent lamp shade. The second end is fixed on the lamp base. With respect to the hollow cavity, the light emitting diode module is located outside the glare shield tube.

Preferably, the light emitting diode bulb with the glare shield structure further includes a reflective layer. With respect to the hollow cavity, the reflective layer covers an outer surface of the glare shield tube and faces the light emitting diode module.

Preferably, the light emitting diode bulb with the glare shield structure further includes a condenser lens sleeved to the outer surface or inner surface of the first end of the glare shield tube. The first end extends to the transparent lamp shade or penetrates a through hole of the transparent lamp shade to protrude above the transparent lamp shade or align with the transparent lamp shade. The second end is fixed at the lamp base. With respect to the hollow cavity, the light emitting diode module is located outside the glare shield tube.

Preferably, the glare shield structure includes a glare shield tube and a shield piece comprising a glare shield portion that defines a hollow portion. The glare shield piece is disposed within the glare shield tube and near the first end. The sensor is accommodated in the hollow portion and the second end of the glare shield tube is fixed at the lamp base.

Preferably, with respect to the glare shield piece, the light emitting diode module is located outside the glare shield tube. The shield portion is tilted toward the light emitting diode module. The upper width of the hollow portion near the transparent lamp shade is larger than its bottom width.

Preferably, the first end of the glare shield tube extends to the transparent lamp shade or penetrates a through hole of the transparent lamp shade to protrude above the transparent lamp shade or align with the transparent lamp shade. With respect to the glare shield piece, the light emitting diode module is located outside the glare shield tube.

Preferably, the light emitting diode bulb with the glare shield structure further includes a condenser lens fixed at outside of the first end of the glare shield tube. The first end extends to the transparent lamp shade or penetrates a through hole of the transparent lamp shade to protrude above the transparent lamp shade. With respect to the glare shield piece, the light emitting diode module is located outside the glare shield tube.

Preferably, the sensor includes an infrared sensor, a microwave sensor, a light sensor, or one or any combination thereof.

Preferably, the lamp base includes a heat dissipation device and a lamp cap. The light emitting diode module is disposed at a first end of the heat dissipation device. The glare shield structure is joggled to the first end of the heat dissipation device or fixed in a first end of a center casing of the heat dissipation device. The lamp cap is disposed at a second end of the heat dissipation device or fixed at a second end of the center casing.

Preferably, the light emitting diode module includes a circuit board disposed with multiple light emitting diodes. The circuit board surrounds the glare shield structure.

Preferably, the circuit board near the glare shield is higher than the circuit board which is away from the glare shield structure.

To achieve the above objective, the present invention further provides a light emitting diode bulb with a glare shield structure. The light emitting diode bulb includes a lamp base having a center casing. At least a portion of the center casing is exposed at a first end of the lamp base. The light emitting diode bulb also includes a light emitting diode module disposed on the lamp base and near the first end of the lamp base. The light emitting diode bulb further includes a condenser lens, a sensor and a glare shield structure with a hollow cavity. The glare shield structure is disposed on that lamp base. The hollow cavity is for accommodating the sensor. A first end of the glare shield structure matches the condenser lens and forms a first glare shield means for preventing light from the light emitting diode module being entered into the glare shield structure from the first end of the glare shield structure and interferes the sensor. The second end of the glare shield structure matches the center casing and forms a second glare shield means for preventing light from the light emitting diode module being entered into the glare shield structure from the second end of the glare shield structure and interferes the sensor.

Preferably, the light emitting diode bulb with the glare shield structure further includes a transparent lamp shade disposed on the lamp base. The first end of the glare shield structure extends to the transparent lamp shade or penetrates a through hole of the transparent lamp shade and protrudes above the transparent lamp shade or aligns with the transparent lamp shade so as to provide the first glare shield means.

Preferably, the glare shield structure is a glare shield tube for providing the hollow cavity. The condenser lens is sleeved to an inner surface or an outer surface of the glare shield tube so as to form the first glare shield means. The second end of the glare shield tube is joggled to the center casing to form the second glare shield means. The sensor is near the first end of the glare shield tube. The light emitting diode module is near the second end of the glare shield tube.

Preferably, the light emitting diode bulb with the glare shield structure further includes a reflective layer covering the outer surface of the glare shield tube and facing to the light emitting diode module.

Preferably, the glare shield structure includes a glare shield tube which provides a hollow cavity, and includes a glare shield piece comprising a shield portion that defines a hollow portion. The glare shield piece is disposed within the glare shield tube and the sensor is accommodated in the hollow portion. A first end of the shield portion is protruded or aligned to a first end of the glare shield tube so as to be the first end of the glare shield structure. The condenser lens is sleeved to an inner surface or outer surface of the first end of the glare shield tube to form the first glare shield means. The second end of the glare shield tube is joggled to the center casing to form the second glare shield means. The sensor is near the first end of the glare shield tube and the light emitting diode module is near the second end of the glare shield tube.

Preferably, a sleeve portion of the condenser lens is between the shield portion of the glare shield piece and the inner surface of the glare shield tube. Alternatively, the sleeve portion is sleeved to the outer surface formed by the glare shield portion of the glare shield piece and the glare shield tube. Alternatively, the sleeve portion is sleeved to the outer surface provided by the glare shield tube.

Preferably, the light emitting diode module includes a circuit board disposed with multiple light emitting diodes. The circuit board surrounds the glare shield structure.

Preferably, the circuit board near the glare shield structure protrudes than the circuit board which is away from the glare shield structure.

Preferably, the first end of the glare shield structure is disposed with at least one hook, and the condenser lens includes a sleeve portion comprising at least a through slot. The hook is hooked to the through slot.

Preferably, the second end of the glare shield structure is disposed with at least one buckle seat, and the center casing includes at least one buckle pin. The buckle seat is joggled to the buckle pin.

Preferably, the lamp base further includes a heat dissipation device having a accommodation hole. The second end of the glare shield structure is disposed with a extruding blocking portion. The center casing is accommodated in the accommodation hole. The blocking portion props the outer edge of the accommodation hole of the heat dissipation device to form the second glare shield means.

The light emitting diode bulb with the glare shield structure of the present invention at least has following advantages. Regarding the lamp base, the sensor and the light emitting diode are disposed at different levels, or so-called segment offset to prevent the sensor interfered by the light emitting diode. The sensor device is accommodated in the glare shield structure. The light emitting diode is located outside the glare shield structure. The glare shield structure prevents light from the light emitting diode to interfere the sensor. The glare shield structure may be respectively matched to the condenser lens and the center casing of the lamp base to form a glare shield means. The glare shield, the condenser lens and the center casing of the lamp base are separated pieces. The glare shield structure may match to the condenser lens and the center casing of the lamp base by a sleeve or joggle structure. Such design increases convenience of assembling, reduces manufacturing cost while ensuring light from the light emitting diode not entering the glare shield structure and interfering the sensor via irradiation, refraction or reflection. The glare shield structure is a one-piece style or a combination type depending on different designs. By matching the glare structure with the transparent lamp shade, light from the light emitting diode is also prevented from being interfered the sensor. The glare shield structure has a tilt design and therefore gives consideration to both preventing light emitting diode and the sensor range. The reflection structure of the glare shield structure further increases illumination range of the light emitting diode. With the tilt angle arrangement of the light emitting diode, the illumination range of the light emitting diode is increased.

DETAILED DESCRIPTION

In the following description, materials of producing the heat dissipation device include but are not limited to aluminum alloy material, magnesium-lithium alloy material, aluminum-magnesium material, or any combination of these materials. Heat dissipation device with high thermal conductivity can rapidly dissipate heat generated by heat sources like a light emitting diode to keep a circuit board containing a light emitting diode to keep in lower temperature and thus enlarges lifetime of a bulb.

The sensor of the present invention mentioned below may be a light sensor for detecting visible or invisible light, e.g. a passive infrared sensor, a microwave sensor or any combination thereof.

Figure 1:
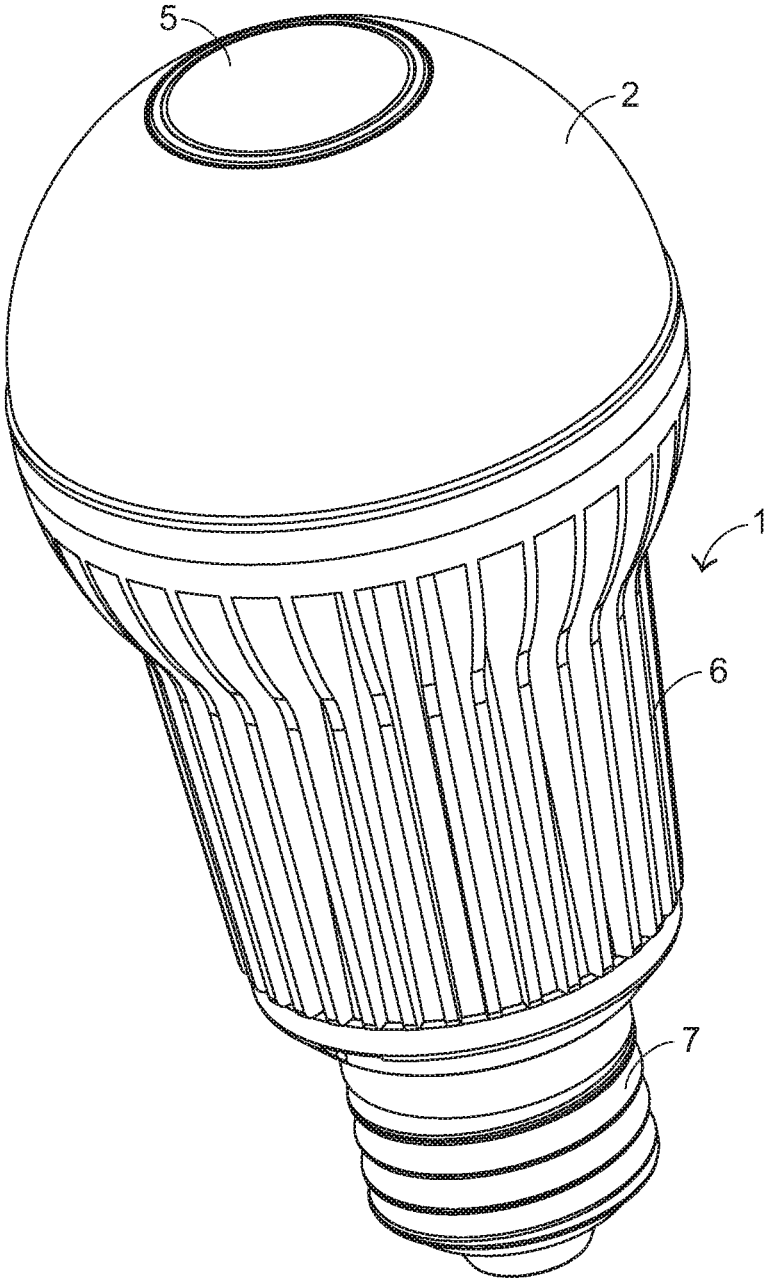
FIG. 1 is a combination overview of a light emitting diode bulb with a glare shield structure of the present invention.

FIG. 1 is a combination view of a light emitting diode bulb with a glare shield structure. Please refer to FIG. 1. It can be found from the outside that the light emitting diode bulb includes a lamp base 1, a transparent lamp shade 2 and a condenser lens 5. The lamp base 1 includes a heat dissipation device 6 and a lamp cap 7.

Figure 2:
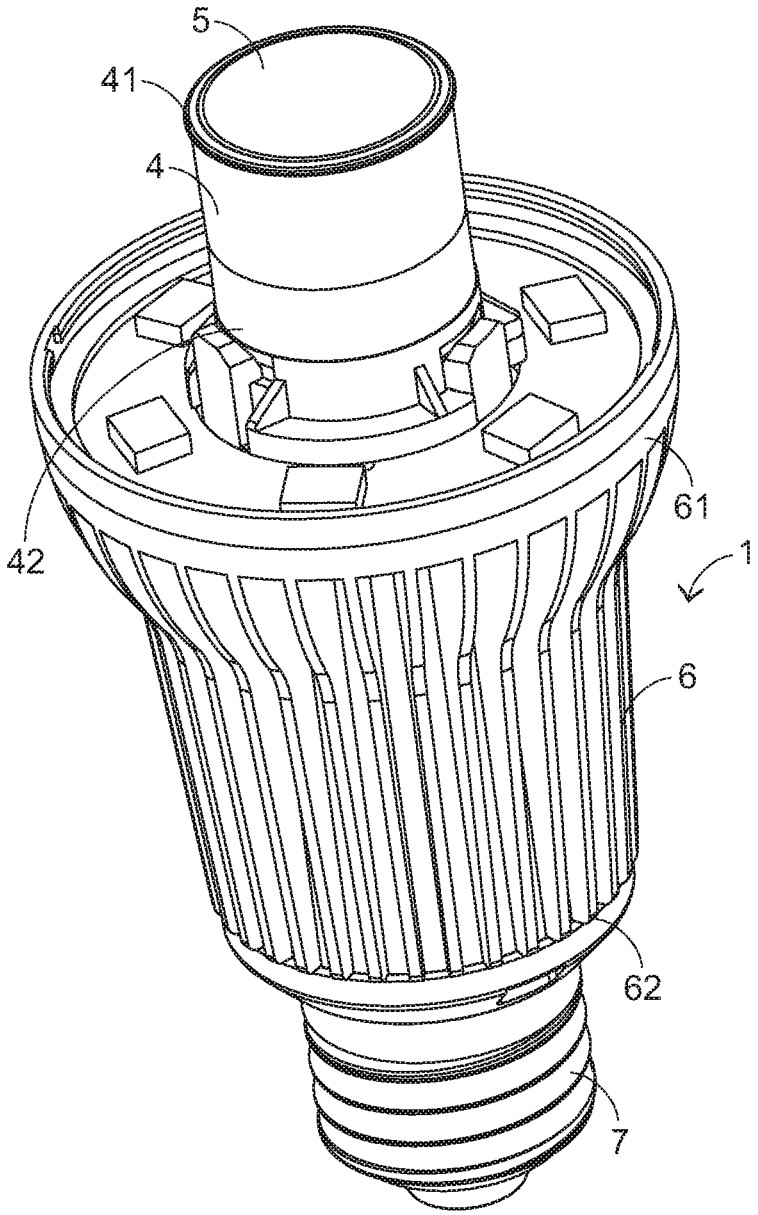
FIG. 2 is a partial exploded diagram of the light emitting diode bulb with the glare shield structure according to a first embodiment of the present invention.

FIG. 2 is a partial exploded view of the light emitting diode with the glare shield structure according to a first embodiment of the present invention. In the first embodiment, the light emitting diode bulb with a glare shield structure includes a glare shield structure, e.g. a glare shield tube 4. The condenser lens 5 is sleeved to inner side of a first end 41 of the glare shield tube 4. A second end 42 of the glare shield tube 4 is near the lamp base 1. The structure of the glare shield tube 4 makes the first end 41 of the glare shield tube 4 protruding above the lamp base 1. The first end 41 and the second end 42 of the glare shield tube 4 have a segment offset relation. The first end 61 of the heat dissipation device 6 is near the second end 42 of the glare shield tube 4. The second end 62 of the heat dissipation device 6 is near the lamp cap 7. The glare shield tube 4 is jogged to the first end 61 of the heat dissipation device 6. The lamp cap 7 is disposed at the second end 62 of the heat dissipation device 6.

Figure 3:
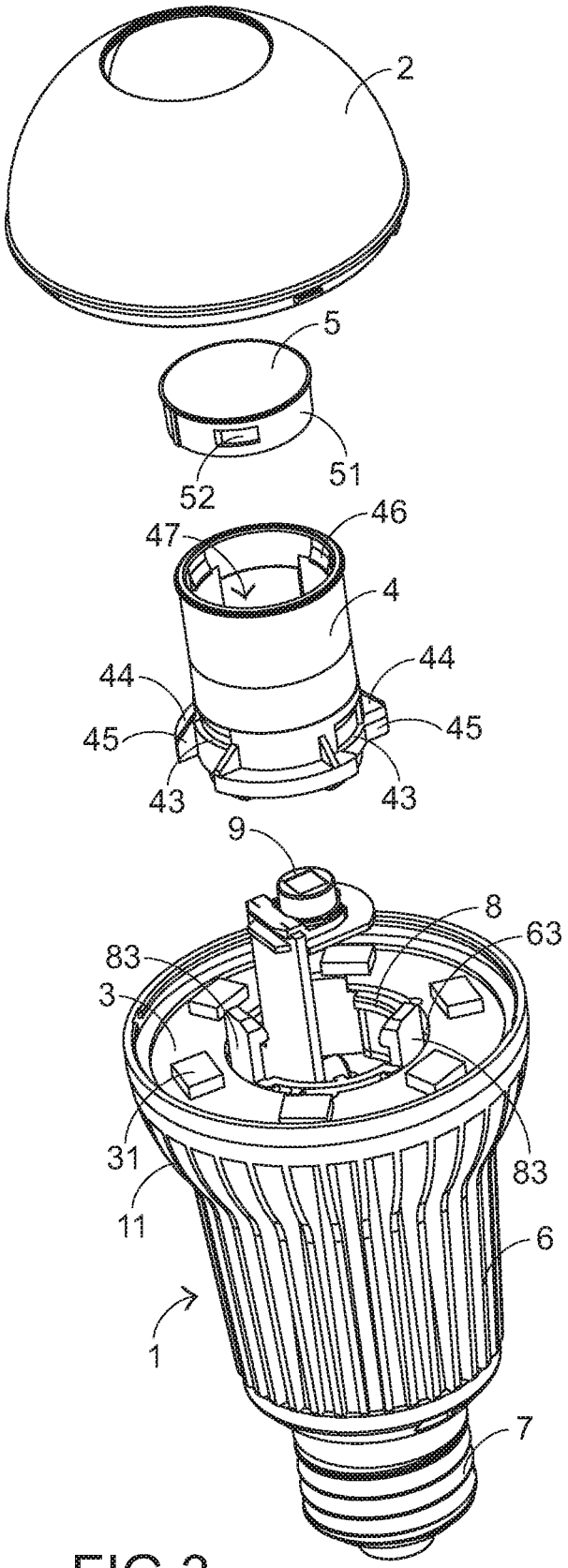
FIG. 3 is a partial exploded diagram of the light emitted diode bulb with the glare shield structure according to the first embodiment of the present invention.
Figure 4:
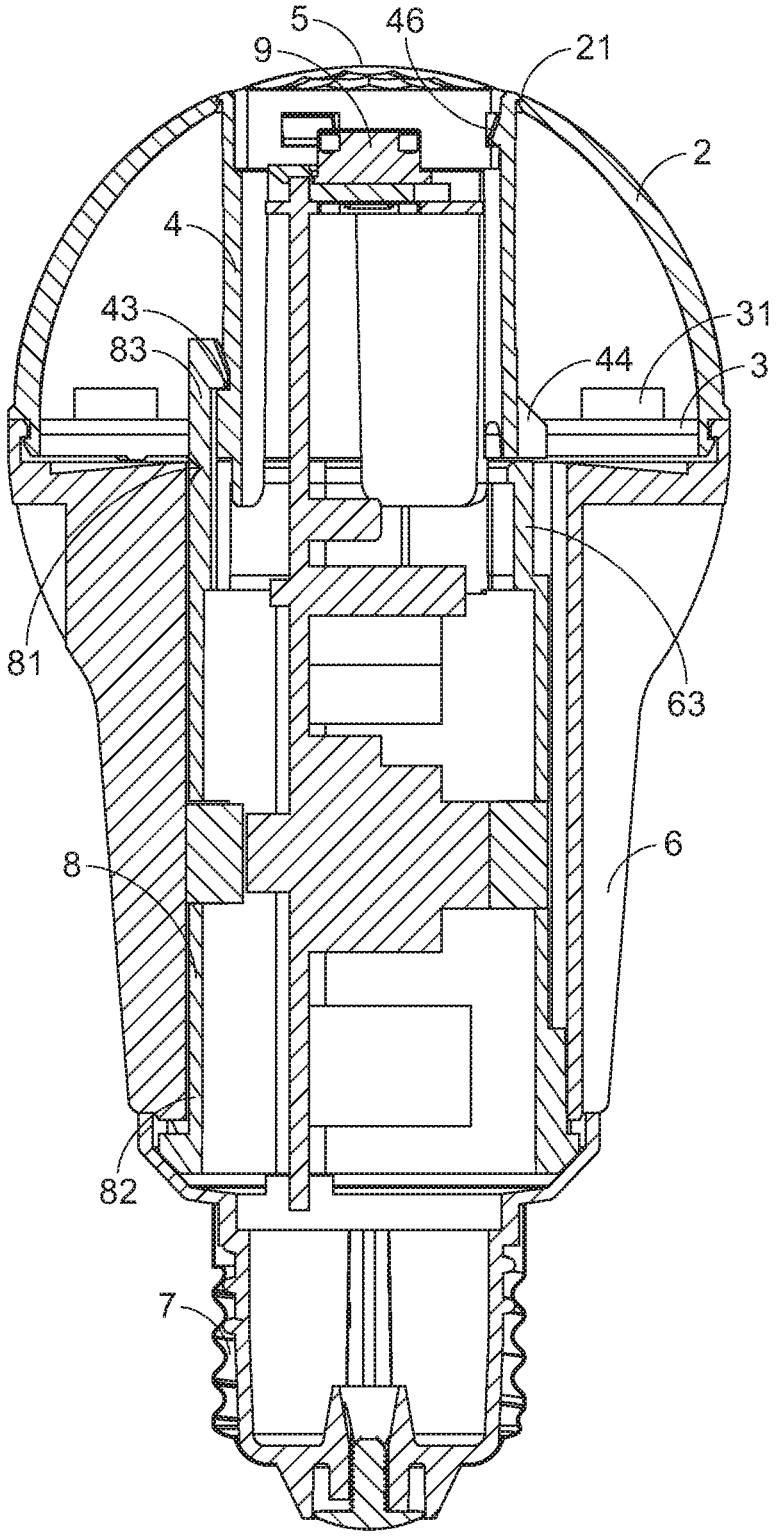
FIG. 4 is an assembling section view of the light emitting diode bulb with the shield structure according to the first embodiment of the present invention.

FIG. 3 is a partial exploded diagram of the light emitted diode bulb with the glare shield structure according to the first embodiment of the present invention. FIG. 4 is an assembling section view of the light emitting diode bulb with the shield structure according to the first embodiment of the present invention. Please refer to FIG. 2, FIG. 3 and FIG. 4. The condenser lens 5 is sleeved to inner side of the first end 41 of the glare shield tube 4. In the first embodiment, the condenser lens 5 has a sleeve portion 51. A through slot 52 is disposed on the sleeve portion 51. The inner side of the lateral side of the glare shield tube 4 defines and provides a hollow cavity 47. The inner side of the lateral side near the first end 41 is disposed with a hook 46 that can be hooked to the through slot 52 of the sleeve portion 51.

In other words, the first end 41 of the glare shield tube 4 matches the condenser lens 5 to form the first glare shield means. The first glare shield means prevents light generated by the light emitting diode module of the circuit board that contains the light emitting diode 41 being entered into the glare shield tube 4 from the first end of the glare shield tube 4 to interfere the sensor 9. In other words, the glare shield tube 4 of the present invention effectively prevents light from the light emitting diode 31 to directly irradiate on the sensor 9. That can also effectively prevent light from the light emitting diode 31 to irradiate on the sensor 9 via reflection or refraction of the transparent lamp shade. When light from the light emitting diode 31 is not received by the sensor 9, the sensor 9 does not respond incorrectly. Sensor accuracy and sensibility are increased.

Moreover, the condenser lens 5 may be sleeved or joggled to the inner surface or outer surface of the first end 41 of the glare shield tube 4 to form the first glare shield means. The condenser lens 5 may match the curve surface of the transparent lamp shade. The arc between the condenser lens 5 and the transparent lamp shade 2 is smooth to make the outer shape have unhindered lines and elegant look. The condenser lens 5 and the glare shield tube 4 are separated components. The condenser lens 5 may be fixed to the glare shield tube 4 via a joggle structure without need of screws. Such assembling design provides flexibility to replace with different designs of condenser lens 5 or assembling according to sensor characteristics of the sensor 9.

The center portion of the heat dissipation device 6 is disposed with a accommodation hole 63. A center casing 8 is plugged in the accommodation hole 63. The bottom end (the second end 82) of the center casing 8 is fixed to the heat dissipation device 6. At least a portion of the center casing 8 is exposed at a first end 11 of the lamp base 1. The first end 81 of the center casing 8 is disposed with at least one buckle pin 83. The second end of the glare shield tube 4 is disposed with a buckle seat 43 corresponding to the buckle pin 83 to be joggled together. That is, the second end 42 of the glare shield tube 4 is joggled and fixed to the lamp base 1 and further joggled to the upper end of the center casing 8. The glare shield tube 4 can be directly joggled to the center casing 8. With such buckle structure joggling, the glare shield tube 4 and the lamp base 1 may be connected without screws or glue but the lamp cap 7 is still able to be fixed to the second end 82 of the center casing 8.

Further, the second end 42 of the glare shield tube 4 is disposed with a protruding blocking portion 44. The blocking portion 44 touches the outer edge of the accommodation hole 63 of the heat dissipation device 6. Besides, an opening 45 is provided for the buckle pin 83 of the center casing 8 to get through at the area of the blocking portion corresponding to the buckle seat 43 of the glare shield tube 4. That is, the second end of the glare shield tube 4 and the center casing 8 are matched to provide the second glare shield means to prevent light from the light emitting diode module to enter to the glare shield tube 4 interfering the sensor from the second end 42 of the glare shield tube 4. Such structure is compact and saves material. Therefore, the assembling of the center casing 8 of the glare shield tube 4 is convenient and fast.

In the first embodiment, an installation surface is disposed at top of the heat dissipation device 6. The circuit board 3 is appressed on the installation surface and sleeved to the first end 61 of the heat dissipation device 6. The circuit board 3 surrounds the second end 42 of the glare shield structure 4. The circuit board 3 that has the light emitting diode 31 is sleeved at the annular area of the lamp base 1 outside the glare shield structure 4. The circuit board 3 is fixed at top of the lamp base 1. With respect to the hollow cavity 47, the circuit board 3 of the light emitting diode module is located outside the glare shield tube 4 and near the second end 42 of the glare shield tube 4. In this embodiment, the circuit board 3, the transparent lamp shade 2, the sensor 9 and the glare shield tube 4 are respectively disposed at the first end (top) of the heat dissipation device 6.

Besides, the transparent lamp shade 2, the sensor 9 and the glare shield tube 4 are respectively disposed at top of the heat dissipation device 6. The glare shield tube 4 is joggled to the first end of the heat dissipation device 6 of the lamp base 1, i.e. the top of the heat dissipation device 6, through the joggled structure without need of glue adhesion or screws. The assembling is simple and easy. Production efficiency is increased and production cost is decreased. The sensor 9 is accommodated within the hollow cavity 47 of the glare shield tube 4. The sensor 9 is near the first end 41 of the glare shield tube 4. Therefore, the glare shield tube 4 serves as a glare shield structure to prevent light from the light emitting module to interfere the sensor 9 so as to prevent light of the light emitting diode to interfere the detection of the sensor 9.

Next, the first end 41 of the glare shield tube 4 may extend to the transparent lamp shade 2. Alternatively, the transparent lamp shade 2 may be disposed with a through hole 21. The first end 41 of the glare shield tube 4 is penetrating the through hole 21 of the transparent lamp shade and protrudes above the transparent lamp shade 2 or aligns with the transparent lamp shade 2. Such structure prevents light from refraction light by the transparent lamp shade 2 on the edge of the first end 41 of the glare shield tube 4 so as to prevent refraction light by the transparent lamp shade 2 onto the sensor 9.

Moreover, in the first embodiment, the circuit board 3 is an annular circuit board. The center portion is hollow to provide the center casing 8 to get through and expose so as to match the second end 42 of the glare shield tube 4. Alternatively, the circuit board may be a circular circuit board that does not have hollow center portion. In such case, the second end of the glare shield tube and the sensor are glued by light-proof glue to be fixed on the circuit board to provide the second glare shield means. Alternatively, the circuit board may be a circular circuit board without hollow center portion, but the circular circuit board includes some through slots. In such case, the second end of the glare shield tube may include extending plug portions to match the through slots. The second glare shield means may be provided by using seal or glue for fixing the plug portions to the slots and around the second end of the glare shield tube.

Figure 5:
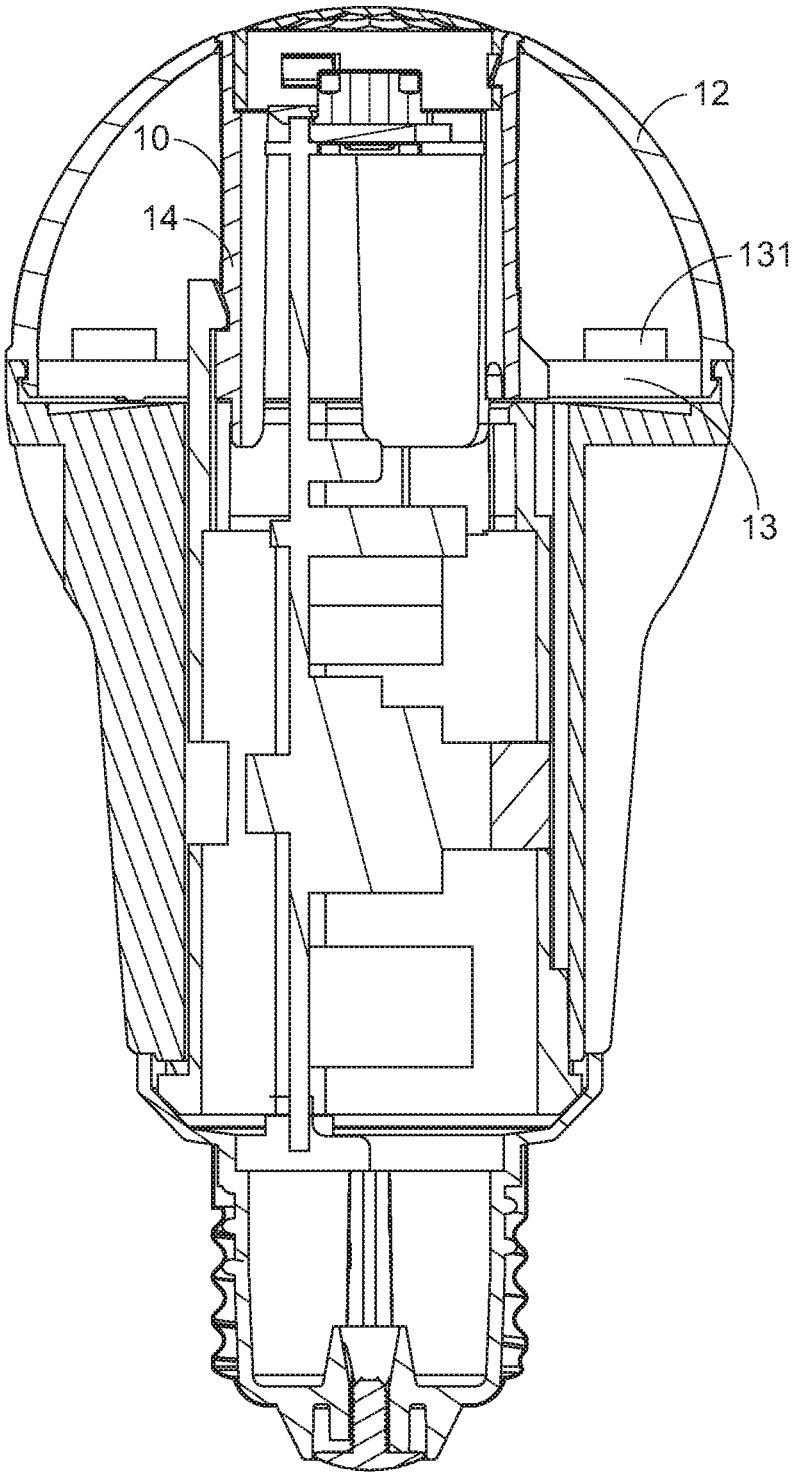
FIG. 5 is an assembling section view of the light emitting diode bulb with the glare shield structure according to a second embodiment of the present invention.

Next, FIG. 5 is an assembling section view of the light emitting diode bulb with the glare shield structure according to a second embodiment of the present invention. Unlike the first embodiment, the glare shield structure further includes a reflective layer 10. With respect to the hollow cavity of the glare shield tube 14, the reflective layer 10 is disposed on an outer surface of the glare shield tube 14 and faces the circuit board 13 of the light emitting diode module. With such, some light from the light emitting diode 131 of the circuit board 13 irradiates on the outer surface of the glare shield tube 14 and then reflects to the transparent lamp shade 12 and then irradiates out from the transparent lamp shade 12. Such structure increases illumination efficiency of the light emitting diode 131 and increases illumination brightness of the light bulb.

Figure 6:
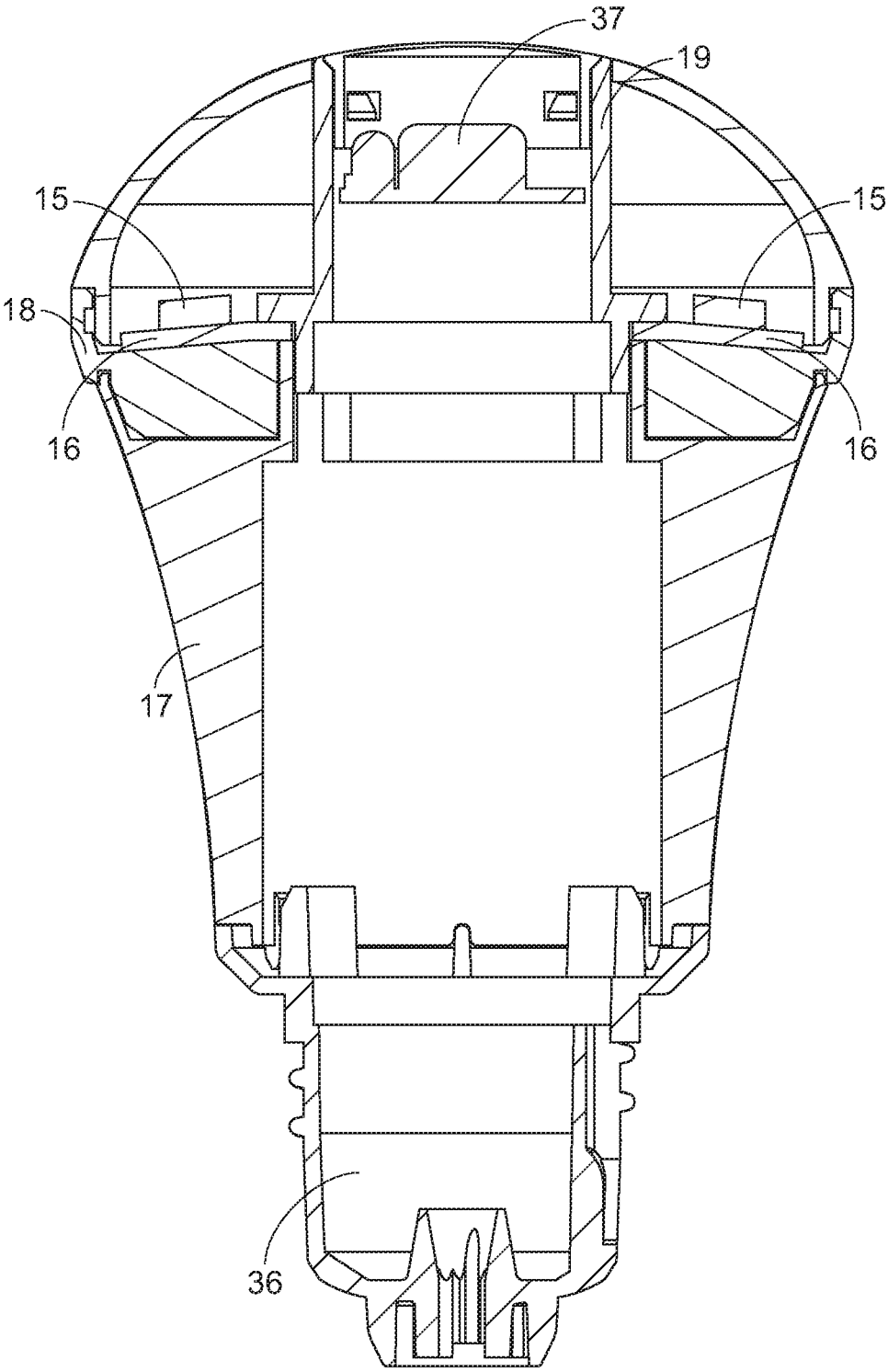
FIG. 6 is an assembling section view of the light emitting diode bulb with the glare shield structure according to a third embodiment of the present invention.

Next, FIG. 6 is an assembling section view of the light emitting diode bulb with the glare shield structure according to a third embodiment of the present invention. Please refer to FIG. 6. The light emitting diode module includes a circuit board 16 disposed with multiple light emitting diodes 15. The circuit board 16 is disposed with a tilt angle so that the height of the center portion of the circuit board 16 is larger than the height of the outer edge of the circuit board 16. In other words, the circuit board 16 near the glare shield structure 19 is higher the circuit board 16 away from the glare shield structure 19. In the third embodiment, the height of the outer edge of the circuit board 16 is decreased to change the illumination range of the light emitting diode 15 of the circuit board. The structure is simple with low cost, small size and fast heat dissipation, and can be used in broad applications.

Besides, the lamp base includes a tube-shape aluminum heat dissipation device 17. The outer surface of the aluminum heat dissipation device 17 is disposed with multiple fins. An installation surface of circular ring shape is disposed on top of the aluminum heat dissipation device 17. The installation surface is disposed with a tilt angle so that the inner side of the installation surface (near the glare shield structure) has a larger edge height than the edge height of the installation outer edge (away from the glare shield structure 19). The circular ring shape circuit board is appressed on the installation surface of the aluminum heat dissipation device 17. The light emitting diode 15 is headed to the upper right side direction of the lamp base, i.e. the light emitting diode 15 is tilted toward the direction away from the glare shield structure 19 to increase illumination range.

The heat dissipation device may have different implementation types, e.g. a combination type or a one-piece type. Therefore, the heat dissipation of the third embodiment may be a combination of a tube-shape aluminum heat dissipation device 17 and metal heat dissipation fins 18. The metal heat dissipation fins 18 is fixed at the top of the aluminum heat dissipation device 17. The metal dissipation fins 18 provides a tilt circular ring installation surface so as to increase illumination range by facing the light emitting diode 15 of the circuit board 16 toward the upper right side direction of the lamp base.

The lamp cap 36 is fixed at the bottom of the aluminum heat dissipation device 17. The center of the aluminum heat dissipation device 17 is configured with a through hole. The circuit board 16 is disposed in the through hole. The sensor 37 is joggled to the top of the aluminum heat dissipation device and located on top of the through hole.

Figure 7:
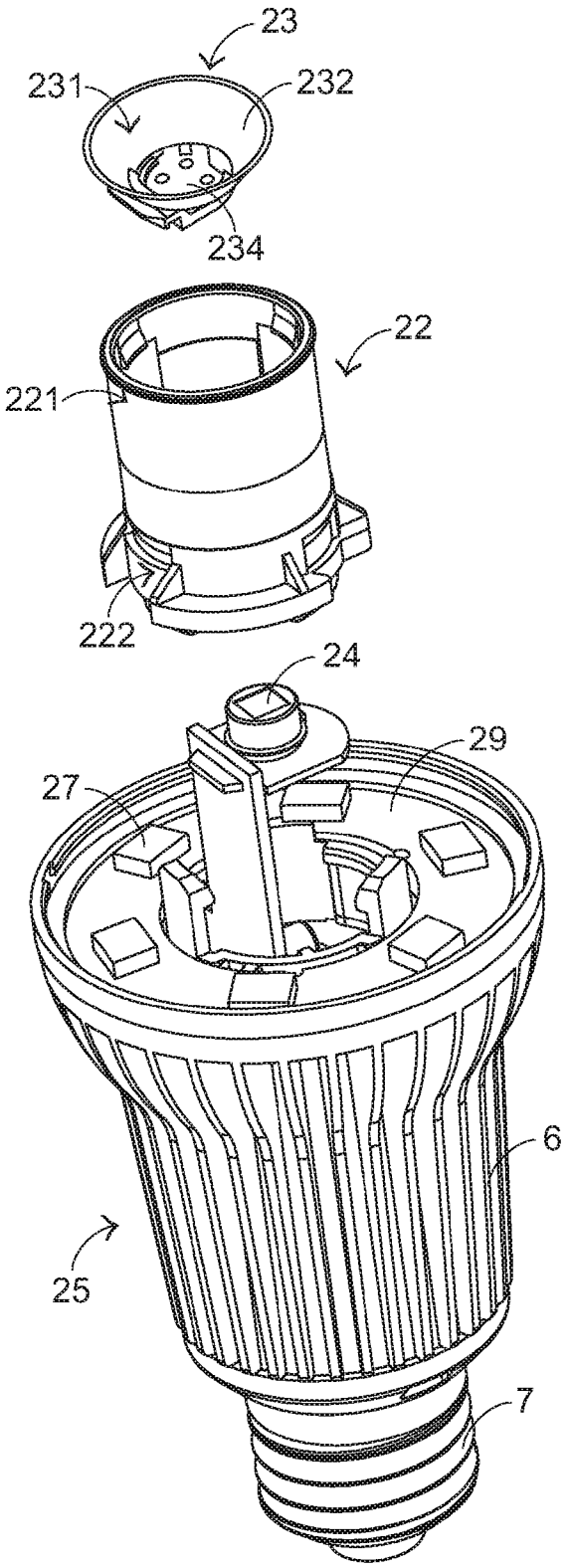
FIG. 7 is a partial exploded view of the light emitting diode bulb with the glare shield structure according to a fourth embodiment of the present invention.

FIG. 7 is a partial exploded view of the light emitting diode bulb with the glare shield structure according to a fourth embodiment of the present invention. The glare shield structure of the fourth embodiment includes a glare shield tube 22 and a glare shield piece 23 comprising a shield portion 232 that defines a hollow portion 231. The glare shield piece 23 is disposed in the glare shield tube 22 and near a first end 221 of the glare shield tube 22. The sensor 24 is accommodated in the hollow portion 231 and may be disposed at the bottom of the hollow portion 231. A second end 222 of the glare shield tube 22 is fixed at the lamp base 25.

Figure 8:
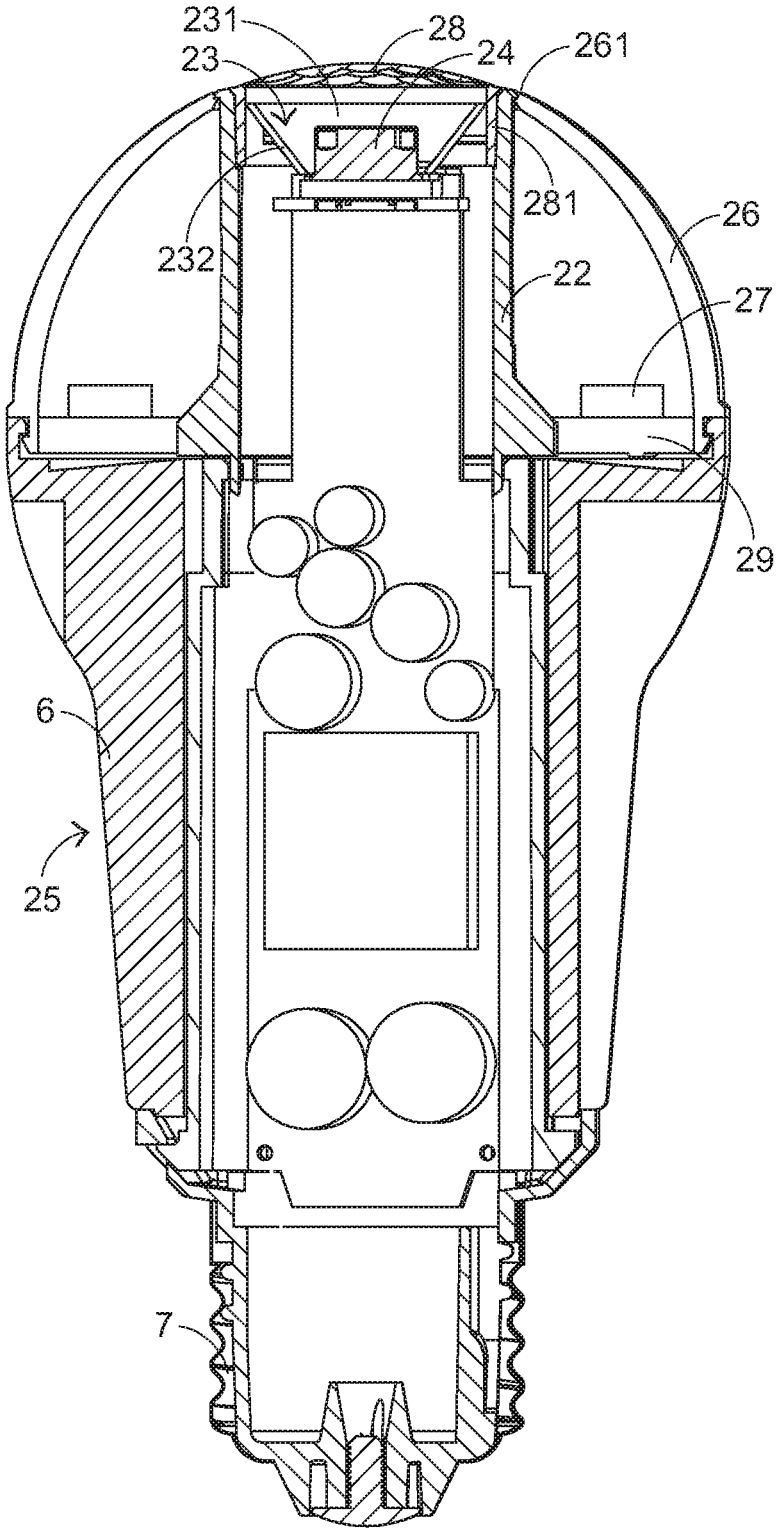
FIG. 8 is an assembling section view of the light emitting diode bulb with the glare shield structure according to the fourth embodiment of the present invention.

FIG. 8 is an assembling section view of the light emitting diode bulb with the glare shield structure according to the fourth embodiment of the present invention. Please refer to FIG. 7 and FIG. 8. The first end 221 of the glare shield tube 22 extends above to the transparent lamp shade 26. The sensor 24 and the glare shield piece 23 are disposed in the hollow cavity of the glare shield tube 22. In the fourth embodiment, the shield portion 232 of the glare shield piece 23 is located around the hollow portion 231. The sensor 24 is accommodated at the center portion of the glare shield piece 23 and enclosed by the shield portion 232. The glare shield piece 23 is sleeved on the middle top end of the glare shield tube 22. The top end (first end) of the shield portion is higher, equal or lower than the edge of the first end 221 of the glare shield tube 22.

The hollow portion 231 is located at center portion of the glare shield piece 23 and has a circular platform surface 234. The top end (first end) of the hollow portion 231 has a larger width than the bottom (second end) width. That is, the width of the hollow portion 231 becomes smaller from the top end to the bottom end. From the view of cross section surface, the angle between the inner edge line and the vertical line of the circular platform surface 234 is larger than the angle between the light which is refracted form the transparent lamp shade 26 to the glare shield tube 22 and the vertical line. The light which is refracted from the lamp shade 26 to the glare shield tube 22 is totally irradiated to the outer surface of the glare shield piece 23, rather than irradiated into the glare shield piece 23, and therefore the light emitting diode 27 is prevented the sensor 24 from being interfered. That increases the sensitivity and motion accuracy of the sensor 24 and avoids incorrect reaction of the sensor 24.

In this embodiment, at least one of the glare shield tube 22 and the glare shield piece 23 can match the condenser lens 28 to form a first glare shield means. The first glare shield means prevents light emitted or refracted from the light emitting diode 27 from being interfered the sensor 24 from the first end 221 of the glare shield tube 22 to enter the glare shield piece 23. The sleeve portion 281 of the condenser lens 28 is sleeved to the inner surface of outer surface of the glare shield tube 22. Specifically, the sleeve portion 281 of the condenser lens 28 may be located between the shield portion 232 of the glare shield piece 23 and an inner surface of the first end 221 of the glare shield tube 22. When the shield portion 232 of the glare shield piece 23 is higher than the first end 221 of the glare shield tube 22, the sleeve portion 281 of the condenser 28 is sleeved to the outer surface formed by the shield portion 232 of the glare shield piece 23 and the glare shield tube 22. When the first end 221 of the glare shield tube 22 is higher or equals to the glare shield portion 232 of the glare shield piece 23, the sleeve portion 281 of the condenser lens 28 is sleeved to the outer surface provided by the glare shield tube 22. Please be noted that the sleeve method of the condenser lens 28 may be the sleeve method of the condenser lens 5 and the glare shield tube 22, or a joggle method, or a any method that pressing elements together.

The first end 221 of the glare shield tube 22 may be plugged upwardly to the through hole 261 of the transparent lamp shade 26. The first end 221 of the glare shield tube 22 or the upper edge of the shield portion 232 of the shield piece 23 align with the upper edge of the through hole 261 of the transparent lamp shade 26. Regarding refracted light refracted from the transparent lamp shade 26 onto the first end 221 of the glare shield tube 22, the first end 221 of the glare shield tube 22 blocks the refracted light onto the sensor 24 in the glare shield piece 23. It can be understood that when the first end 221 of the glare shield tube 22 or the upper edge of the shield portion 232 of the glare shield piece 23 protrudes above or is higher than the upper edge of the through hole 261 of the transparent lamp shade 26, refracted light refracted by the transparent lamp shade 26 onto edge of the first end 221 of the glare shield tube 22 is prevented form irradiating on the sensor 24 in the glare shield piece 23.

In the fourth embodiment, the circuit board 29 disposed with light emitting diode 27 surrounds the glare shield tube 22. Like the circuit board 16 of the third embodiment in FIG. 6, the circuit board 29 near the glare shield tube 22 protrudes higher than the circuit board 29 which is away from the glare shield tube 22. Based on above description, the light emitting diode bulb with a glare shield structure at least has following advantages:

(1) with respect to the lamp base, the sensor and the light emitting diode are disposed at different levels, or so-called segment offset relation, and such design prevents the sensor being interfered by the light emitting diode;

(2) the sensor is accommodated in the glare shield structure, the light emitting diode is located outside the glare shield structure, and thus the glare shield structure prevents light emitted from the light emitting diode form being interfered the sensor;

(3) the glare shield structure may separately match the condenser lens and the center casing of the lamp base to form glare shield means to respectively avoid light emitted from the light emitting diode interfering the sensor from both the upper end and bottom end of the sensor;

(4) the glare shield structure, the condenser lens and the center casing of the lamp base are separated components, the glare shield structure may match the condenser lens and center casing of the lamp base with sleeve or joggle structure to increase assembling convenience and to reduce assembling cost while ensuring light emitted from the light emitting diode to enter the glare shield structure and interfere the sensor via irradiation, refraction or reflection;

(5) the glare shield structure may be designed as one-piece or combination type to meet different designs;

(6) by matching the structure of the glare shield structure with the transparent lamp shade, light from the light emitting diode is also prevented from interfering the sensor;

(7) by tilt design of the glare shield structure, considerations are given to both ranges of the light emitting diode and the sensor;

(8) by the reflection structure of the glare shield structure, the illumination range of the light emitting diode is further increased; and (9) by arranging the tilt angle of the light emitting diode, the illumination range of the light emitting diode is increased.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A light emitting diode bulb with a glare shield structure, comprising a lamp base, a transparent lamp shade, a light emitting diode module, a sensor and a glare shield structure, wherein the glare shield structure accommodates the sensor to prevent the sensor from being interfered by the light emitting from the light emitting diode module, characterized in that the glare shield structure provides a hollow cavity for accommodating a glare shield tube of the sensor, and the sensor is disposed near a first end of the glare shield tube, or characterized in that the glare shield structure provides a hollow cavity for accommodating a glare shield tube of the sensor, and the sensor is disposed near a first end of the glare shield tube, and the first end of the glare shield tube extends to the transparent lamp shade or penetrates a through hole of the transparent lamp shade to protrude above the lamp shade or align the lamp shade, a second end of the glare shield tube is fixed to the lamp base and with respect to the hollow cavity, the light emitting diode module is located outside of the glare shield tube and near the second end of the glare shield tube, or characterized in that the glare shield structure provides a hollow cavity for accommodating a glare shield tube of the sensor, and the sensor is disposed near a first end of the glare shield tube, and the glare shield structure further comprises a reflective layer and with respect to the hollow cavity, the reflective layer is fixed at an outer surface of the glare shield tube and faced to the light emitting diode module, or characterized in that the glare shield structure provides a hollow cavity for accommodating a glare shield tube of the sensor, and the sensor is disposed near a first end of the glare shield tube, and further comprises a condenser lens sleeved to outer side or inner side of the glare shield tube, the first end of the glare shield tube extends to the transparent lamp shade or penetrates a through hole of the transparent lamp shade to protrude the transparent lamp shade or align with the transparent lamp shade, a second end of the glare shield tube is fixed at the lamp base, and with respect to the hollow cavity, the light emitting diode module is located outside the glare shield tube and is near the second end of the glare shield tube.

2. A light emitting diode bulb with a glare shield structure, comprising a lamp base, a transparent lamp shade, a light emitting diode module, a sensor and a glare shield structure, wherein the glare shield structure accommodates the sensor to prevent the sensor from being interfered by the light emitting from the light emitting diode module, characterized in that the glare shield structure comprises a glare shield tube and a glare shield piece comprising a shield portion defining a hollow portion, the glare shield piece is disposed within the glare shield tube and near a first end of the glare shield tube, the sensor is accommodated in the hollow portion, the second end of the glare shield tube is fixed on the lamp base, or characterized in that the glare shield structure comprises a glare shield tube and a glare shield piece comprising a shield portion defining a hollow portion, the glare shield piece is disposed within the glare shield tube and near a first end of the glare shield tube, the sensor is accommodated in the hollow portion, the second end of the glare shield tube is fixed on the lamp base, with respect to the glare shield piece, the light emitting diode module is located outside the glare shield tube and near the second end of the glare shield tube, the shield portion is tilted toward the light emitting diode module, and the upper width of the hollow portion near the transparent lamp shade is larger than the bottom width of the hollow portion, or characterized in that the glare shield structure comprises a glare shield tube and a glare shield piece comprising a shield portion defining a hollow portion, the glare shield piece is disposed within the glare shield tube and near a first end of the glare shield tube, the sensor is accommodated in the hollow portion, the second end of the glare shield tube is fixed on the lamp base, and the first end of the glare shield tube extends to the transparent lamp shade or penetrates a through hole of the transparent lamp shade to protrude above the transparent lamp shade or align with the transparent lamp shade, and with respect to the glare shield piece, the light emitting diode module is located outside the glare shield tube, and near the second end of the glare shield tube, or characterized in that the glare shield structure comprises a glare shield tube and a glare shield piece comprising a shield portion defining a hollow portion, the glare shield piece is disposed within the glare shield tube and near a first end of the glare shield tube, the sensor is accommodated in the hollow portion, the second end of the glare shield tube is fixed on the lamp base, and further comprises a condenser lens fixed to the first end of the glare shield tube and the first end extends to the transparent lamp shade or penetrates a through hole of the transparent lamp shade to protrude the transparent lamp shade or align with the transparent lamp shade, and with respect to the glare shield piece, the light emitting diode module is located outside the glare shield tube and near the second end of the glare shield tube.

3. A light emitting diode bulb with a glare shield structure, comprising a lamp base, a transparent lamp shade, a light emitting diode module, a sensor and a glare shield structure, wherein the glare shield structure accommodates the sensor to prevent the sensor from being interfered by the light emitting from the light emitting diode module, characterized in that the sensor comprises one or multiple types from an infrared sensor, a microwave sensor, and a light sensor, or characterized in that the lamp base comprises a heat dissipation device and a lamp cap, the light emitting diode module is disposed at a first end of the heat dissipation device, the glare shield structure is joggled to the first end of the heat dissipation device or accommodated in a first end of a center casing of the heat dissipation device, and the lamp cap is disposed at a second end of the heat dissipation device or fixed at a second end of the center casing of the heat dissipation device, or characterized in that the light emitting diode module comprises a circuit board disposed with a plurality of light emitting diodes, and the circuit board surrounds the glare shield structure, or characterized in that the light emitting diode module comprises a circuit board disposed with a plurality of light emitting diodes, and the circuit board surrounds the glare shield structure, and the circuit board near the glare shield structure is higher than the circuit board away the shield structure.

4. A light emitting diode bulb with a glare shield structure, comprising a lamp base, a transparent lamp shade, a light emitting diode module and a sensor, characterized in further comprising a glare shield structure for accommodating the sensor, wherein the sensor is near a first end of the glare shield structure, the light emitting diode module is near a second end of the glare shield structure, and the glare shield structure prevents the sensor from being interfered by the light emitted from the light emitting diode module.

5. The light emitting diode bulb with glare shield structure of claim 4, characterized in that the glare shield structure is a glare shield tube with a hollow cavity for accommodating a glare shield tube of the sensor, or characterized in that the glare shield structure is a glare shield tube with a hollow cavity for accommodating a glare shield tube of the sensor, and there is a segment offset relation between the first end and the second end of the glare shield tube, the first end extends to the transparent lamp shade or penetrates a through hole of the transparent lamp shade to protrude the transparent lamp shade or align with the lamp shade, the second end is fixed at the lamp base, and with respect to the hollow cavity, the light emitting diode module is located outside the glare shield tube, or characterized in that the glare shield structure is a glare shield tube with a hollow cavity for accommodating a glare shield tube of the sensor, and further comprises a reflective layer, and with respect to the hollow cavity, the reflective layer covers an outer surface of the glare shield tube and faces to the light emitting diode module, or characterized in that the glare shield structure is a glare shield tube with a hollow cavity for accommodating a glare shield tube of the sensor, and further comprises a condenser lens sleeved to an outer surface or an inner surface of the first end of the glare shield tube, and the first end extends to the transparent lamp shade or penetrates a through hole to protrude the transparent lamp shade or align with the transparent lamp shade, the second end is fixed at the lamp base, and with respect to the hollow cavity, the light emitting diode module is located outside the glare shield tube.

6. The light emitting diode bulb with glare shield structure of claim 4, characterized in that the glare shield structure comprises a glare shield tube and a glare shield piece comprising a shield portion defining a hollow portion, the glare shield piece is disposed within the glare shield tube and is near the first end, the sensor is accommodated in the hollow portion, and the second end of the glare shield tube is fixed on the lamp base, or characterized in that the glare shield structure comprises a glare shield tube and a glare shield piece comprising a shield portion defining a hollow portion, the glare shield piece is disposed within the glare shield tube and is near the first end, the sensor is accommodated in the hollow portion, and the second end of the glare shield tube is fixed on the lamp base, and with respect to the glare shield piece, the light emitting diode module is located outside the glare shield tube, and the shield portion is tilted toward the light emitting diode module, and the width of the hollow portion near the transparent lamp shade is larger than the bottom width of the hollow portion, or characterized in that the glare shield structure comprises a glare shield tube and a glare shield piece comprising a shield portion defining a hollow portion, the glare shield piece is disposed within the glare shield tube and is near the first end, the sensor is accommodated in the hollow portion, and the second end of the glare shield tube is fixed on the lamp base, and the first end of the glare shield tube extends to the transparent lamp shade or penetrates a through hole of the transparent lamp shade to protrude the transparent lamp shade or align with the lamp shade, and with respect to the glare shield piece, the light emitting diode module is located outside the glare shield tube, or characterized in that the glare shield structure comprises a glare shield tube and a glare shield piece comprising a shield portion defining a hollow portion, the glare shield piece is disposed within the glare shield tube and is near the first end, the sensor is accommodated in the hollow portion, and the second end of the glare shield tube is fixed on the lamp base, and further comprises a condenser lens fixed to the first end of the glare shield tube and the first end extends to the transparent lamp shade or penetrates a through hole of the transparent lamp shade to protrude the transparent lamp shade, and with respect to the glare shield piece, the light emitting diode module is located outside the glare shield tube and near the second end of the glare shield tube.

7. The light emitting diode bulb with glare shield structure of claim 4, characterized in that the sensor comprises one or multiple types of an infrared sensor, a microwave sensor and a light sensor, or characterized in that the lamp base comprises a heat dissipation device and a lamp cap, the light emitting diode module is disposed at a first end of the heat dissipation device, the glare shield structure is joggled to the first end of the heat dissipation device or fixed in a first end of a center casing of the heat dissipation device, the lamp cap is disposed at a second end of the heat dissipation device or fixed at a second end of the center casing, or characterized in that the light emitting diode module comprises a circuit board disposed with multiple light emitting diodes, and the circuit board surrounds the glare shield structure, or characterized in that the light emitting diode module comprises a circuit board disposed with multiple light emitting diodes, and the circuit board surrounds the glare shield structure, and the circuit board near the glare shield structure is higher than the circuit board which is away from the glare shield structure.

8. A light emitting diode bulb with glare shield structure, comprising: a lamp base, the lamp base comprising a center casing, wherein at least a portion of the center casing is exposed to a first end of the lamp base; a light emitting diode module disposed on the lamp base and near the first end of the lamp base; a condenser lens; a sensor; and a glare shield structure having an hollow cavity, disposed on the lamp base, the hollow cavity accommodating the sensor, wherein a first end of the glare shield structure matches the condenser lens, and the first end of the glare shield structure and the condenser lens form a first glare shield means to prevent the light emitting from the light emitting diode module from entering the glare shield structure via the first end of the glare shield structure and from interfering the sensor, and a second end of the glare shield structure matches the center casing, and the second end and the center casing form a second glare shield means to prevent the light emitting from the light emitting diode module from entering the glare shield structure via the second end of the glare shield structure and interferes the sensor.

9. The light emitting diode bulb with glare shield structure of claim 8, characterized in further comprising a transparent lamp shade disposed on the lamp base, the first end of the glare shield structure extends to the transparent lamp shade or penetrates a through hole of the transparent lamp shade to protrude the transparent lamp shade or align with the transparent lamp shade to provide the first glare shield means, or characterized in further comprising a transparent lamp shade disposed on the lamp base, the first end of the glare shield structure extends to the transparent lamp shade or penetrates a through hole of the transparent lamp shade to protrude the transparent lamp shade or align with the transparent lamp shade to provide the first glare shield means, and the glare shield structure is a glare shield tube for providing the hollow cavity, the condenser lens is sleeved to an inner surface or an outer surface of the glare shield tube so as to form the first glare shield means, the second end of the glare shield tube is joggled to the center casing to form the second glare shield means, the sensor is near the first end of the glare shield tube, and the light emitting diode module is near the second end of the glare shield tube, or characterized in further comprising a transparent lamp shade disposed on the lamp base, the first end of the glare shield structure extends to the transparent lamp shade or penetrates a through hole of the transparent lamp shade to protrude the transparent lamp shade or align with the transparent lamp shade to provide the first glare shield means, and the glare shield structure is a glare shield tube for providing the hollow cavity, the condenser lens is sleeved to an inner surface or an outer surface of the glare shield tube so as to form the first glare shield means, the second end of the glare shield tube is joggled to the center casing to form the second glare shield means, the sensor is near the first end of the glare shield tube, and the light emitting diode module is near the second end of the glare shield tube, and further comprises a reflective layer covering the outer surface of the glare shield tube and facing to the light emitting diode module.

10. The light emitting diode bulb with glare shield structure of claim 9, characterized in further comprising a transparent lamp shade disposed on the lamp base, the first end of the glare shield structure extends to the transparent lamp shade or penetrates a through hole of the transparent lamp shade to protrude the transparent lamp shade or align with the transparent lamp shade to provide the first glare shield means, and the glare shield structure comprises a glare shield tube which provides a hollow cavity, and includes a glare shield piece comprising a shield portion defining an hollow portion, the glare shield piece is disposed within the glare shield tube and the sensor is accommodated in the hollow portion, a first end of the shield portion is protruded or aligned to a first end of the glare shield tube so as to be the first end of the glare shield structure, the condenser lens is sleeved to an inner surface or outer surface of the first end of the glare shield tube to form the first glare shield means, the second end of the glare shield tube is joggled to the center casing to form the second glare shield means, the sensor is near the first end of the glare shield tube and the light emitting diode module is near the second end of the glare shield tube, or characterized in further comprising a transparent lamp shade disposed on the lamp base, the first end of the glare shield structure extends to the transparent lamp shade or penetrates a through hole of the transparent lamp shade to protrude the transparent lamp shade or align with the transparent lamp shade to provide the first glare shield means, and the glare shield structure comprises a glare shield tube which provides a hollow cavity, and includes a glare shield piece comprising a shield portion defining an hollow portion, the glare shield piece is disposed within the glare shield tube and the sensor is accommodated in the hollow portion, a first end of the shield portion is protruded or aligned to a first end of the glare shield tube so as to be the first end of the glare shield structure, the condenser lens is sleeved to an inner surface or outer surface of the first end of the glare shield tube to form the first glare shield means, the second end of the glare shield tube is joggled to the center casing to form the second glare shield means, the sensor is near the first end of the glare shield tube and the light emitting diode module is near the second end of the glare shield tube, and a sleeve portion of the condenser lens is between the shield portion of the glare shield piece and the inner surface of the glare shield tube; or the sleeve portion is sleeved to the outer surface formed by the covering portion of the glare shield piece and the glare shield tube; the sleeve portion is sleeved to the outer surface provided by the glare shield tube.

11. The light emitting diode bulb with the glare shield structure of claim 8, characterized in that the light emitting diode module comprises a circuit board disposed with a plurality of light emitting diodes, and the circuit board surrounds the glare shield structure, or characterized in that the light emitting diode module comprises a circuit board disposed with a plurality of light emitting diodes, and the circuit board surrounds the glare shield structure, and the circuit board near the glare shield structure is higher than the circuit board which is away from the glare shield structure.

12. The light emitting diode bulb with the glare shield structure of claim 8, characterized in that the first end of the glare shield structure is formed with at least one hook, the condenser lens includes a sleeve portion comprising at least a through slot, and the hook is hooked to the through slot, or characterized in that at least one buckle seat is disposed at the second end of the glare shield structure, the center casing includes at least one buckle pin, and the buckle seat is joggled to the buckle pin, or characterized in that the lamp base further includes a heat dissipation device having a accommodation hole, the second end of the glare shield structure is disposed with a extruding blocking portion, the center casing is accommodated in the accommodation hole, and the blocking portion props the outer edge of the accommodation hole of the heat dissipation device to form the second glare shield means.

* * * * *